United States Patent [19]

Dahl

[11] Patent Number: 4,659,967

[45] Date of Patent: Apr. 21, 1987

[54] MODULATION CIRCUIT FOR A LIGHT EMITTING DEVICE

[75] Inventor: Randy L. Dahl, Scottsdale, Ariz.

[73] Assignee: Motorola Inc., Schaumburg, Ill.

[21] Appl. No.: 759,813

[22] Filed: Jul. 29, 1985

[51] Int. Cl.[4] ..... H05B 37/02

[52] U.S. Cl. ..... 315/307; 315/241 R; 315/209 R; 307/270; 340/782

[58] Field of Search ..... 315/241, 209, 307, 171, 315/173, 205, 240; 340/782; 307/270, 254, 311

[56] References Cited

U.S. PATENT DOCUMENTS 4,500,812 2/1985 Roche ..... 315/241 R

*Primary Examiner*—David K. Moore
*Assistant Examiner*—M. Razavi
*Attorney, Agent, or Firm*—Raymond J. Warren; Eugene A. Parsons

[57] ABSTRACT

The present invention consists of a modulation circuit used in a digital application. The modulation circuit is designed to provide an LED with a more analog type signal. This in turn causes the LED to emit a signal that is peaked rather than a constant square wave providing a better conversion frequency to the fundamental frequency.

4 Claims, 4 Drawing Figures

– PRIOR ART –

– PRIOR ART –

MODULATION CIRCUIT FOR A LIGHT EMITTING DEVICE

BACKGROUND OF THE INVENTION

The present invention relates, in general, to light emitting devices and, in particular, to modulation circuits for light emitting devices.

The modulation circuits currently used to drive light emitting devices consist of voltage regulators coupled to a light emitting device by a switch. The switch is then triggered by an oscillator of some type. This type of modulation circuit, while effective, does not make efficient use of the energy expended to drive the light emitting device.

SUMMARY OF THE INVENTION

Accordingly, it is an object of the present invention to provide a modulation circuit that overcomes the deficiencies set out above.

Another object of the present invention is to provide a modulation circuit that provides a more efficient use of the power consumed.

Still another object of the present invention is to provide the improved modulation circuit that utilizes existing parts.

Yet another object of the present invention is to provide a modulation circuit that does not increase the cost.

Another object of the present invention is to provide a modulation circuit that is compatible with existing circuits.

A particular embodiment of the present invention consists of a modulation circuit having a power supply and a ground. The modulation circuit comprises a voltage regulating means for regulating the voltage. The voltage regulating means has an input, an output, and a reference line. The input of the voltage regulating means is coupled to the power supply. A resistor is used having a first end and a second end. The first end of the resistor is coupled to the output of the voltage regulating means. The second end of the resistor is coupled to the reference line of the voltage regulating means. The device also includes a capacitor having a first end and a second end. The first end of the capacitor is coupled to the second end of the resistor. The second end of the capacitor is coupled to the ground. The device further includes a switch means for providing a signal. The switch means has an input, an output and a control line. The input of the switch means is coupled to the reference of the voltage regulating means. An oscillating means is also contained in the device for providing an oscillating signal. The oscillating means has an output coupled to the control line of the switch means. Finally, the device contains a light emitting diode having an anode and cathode. The anode is coupled to the output of the switch means. The cathode is coupled to the ground of the device.

DETAILED DESCRIPTION OF THE INVENTION

Figure 1:
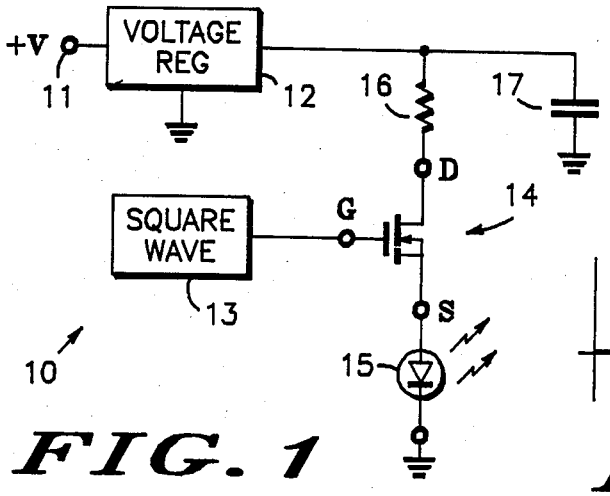
FIG. 1 is a prior art illustration of an LED modulation circuit.
Figure 2:
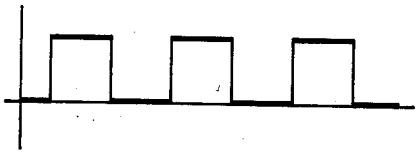
FIG. 2 is a signal diagram of a signal provided to the LED of FIG. 1.

Referring to FIG. 1 a prior art modulation circuit, generally designated 10, is illustrated. In the following examples a light emitting diode (LED) will be used to illustrate light emitting devices. It should be noted, however, that this is not limited to LEDs. Circuit 10 consists of a voltage supply, not shown, being coupled to a node 11; a voltage regulator 12 (such as an LM309H manufactured by Motorola, Inc.; and square wave generator 13. Circuit 10 also consists of a switch 14; an LED 15; a resistor 16 and a capacitor 17.

Voltage regulator 12 has an input coupled to node 11; an output coupled to one end of resistor 16 and to one end of capacitor 17; and a ground. The second end of capacitor 17 is coupled to ground. The second end of resistor 16 is coupled to the drain of switch 14, here a MOS device. The gate of switch 14 is coupled to the output of square wave generator 13. The source of switch 14 is coupled to the anode of LED 15. The cathode of LED 15 is coupled to ground.

Square wave generator 13 acts as the switching mechanism for switch 14. Square wave generator 13 causes switch 14 to be opened and closed which causes a square wave current to be provided at the anode of LED 15. This square wave current will cause LED 15 to be turned on and off.

While this circuit is sufficient to operate LED 15, a portion of the energy produced is not effectively utilized. In addition, this signal causes an output signal from LED 15 to be seen as a square wave which is more difficult for a receptor to read than other types of signals.

The waveform of the signal output from LED 15 is a square wave, the fourier series for which is known in the art to be:

$$(4/\pi)[\cos(w_o t)-(\tfrac{1}{3})\cos(3w_o t)+(1/5)\cos(5w_o t)\ldots] \quad (1)$$

where:

$w_o$=the fundamental frequency; and t=time.

The efficiency of this device can be defined by the equation:

$$\%_{eff}=(P_{eff}/P_{total}) \quad (2)$$

where:

$\%_{eff}$=the percentage of the power efficiently used;

$P_{eff}$=the power efficiently used; and $P_{total}$=the total power.

This can also be defined by the equation:

$$\%_{eff}=(C_1)^2/\left[\sum_{i=1}^{\infty}(|C_i|)^2\right] \quad (3)$$

For the present square wave $C_1=1$, $C_2=\frac{1}{3}$, and $C_3=1/5$. Substituting these into equation (3) results in a $\%_{eff}$ of approximately 87%.

Figure 3:
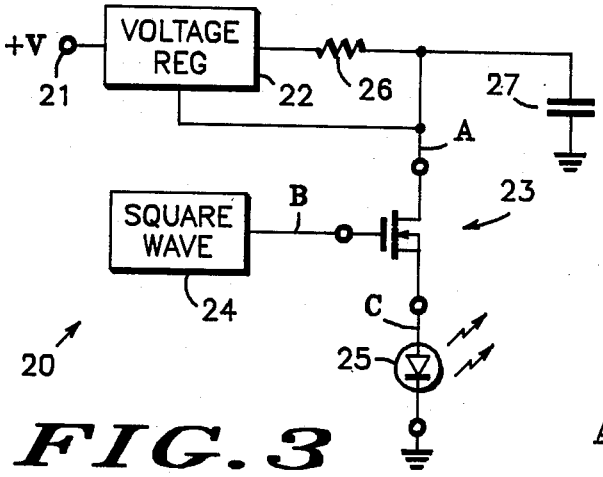
FIG. 3 is an illustration of an LED modulation circuit embodying the present invention.

Referring now to the diagram of FIG. 3 a modulation circuit, generally designated 20, is illustrated embodying the present invention. Circuit 20 consists of a voltage supply, +V, (not shown) coupled to a node 21; a voltage regulator 22; and a switch 23. In addition, circuit 20 consists of a square wave generator 24; an LED 25; a resistor 26 and a capacitor 27.

Voltage regulator 22 has an input coupled to node 21; an output coupled to one end of resistor 26; and a reference coupled to the second end of resistor 26, the first end of capacitor 27 and the drain of switch 23. The second end of capacitor 27 is coupled to ground. Square wave generator 25 has an output coupled to the gate of switch 23. The source of switch 23 is coupled to the anode of LED 25. The cathode of LED 25 is coupled to ground.

Figure 4:
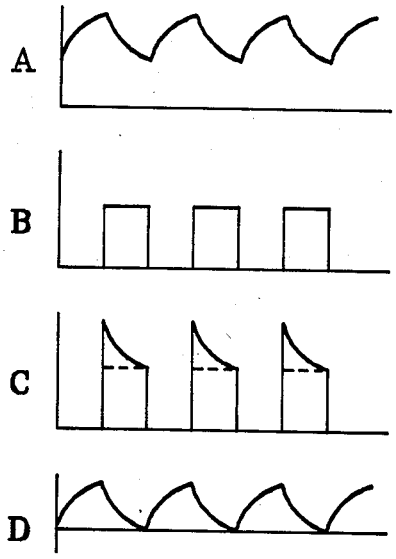
FIG. 4 illustrates some of the signals found throughout the circuit of FIG. 3.

In operation a voltage is provided at point A. This is illustrated in FIG. 4, graph A. The voltage signal from square wave generator 24 is illustrated in FIG. 4, graph B. This signal from square wave generator 24 is applied to the gate of switch 23. Here a MOSFET transistor is utilized, however, it should be noted that any type of switching device may be used. Switch 23 is thereby opened and closed producing a current signal at the source which is shown in FIG. 4, graph C.

This type of current, when applied to LED 25, provides a more efficient use of the power expanded.

The output signal of LED 25 is illustrated in FIG. 4, graph D. The Fourier Series of this waveform is complicated but may be approximated by that of a Triangle waveform to be:

$$8/\pi^2[\cos(w_o t)-(1/9)\cos(3w_o t)+(1/25)\cos(5w_o t)\ldots] \quad (4)$$

The power efficiency of this triangle waveform can be determined by substituting the coefficients (1, 1/9, and 1/25) into equation (3). This gives an efficiency of approximately 99%. Since the actual waveform is not triangular the efficiency would fall between the 87% of the square wave and the 99% of the triangle waveform.

In operation voltage regulator 22 has a floating reference. When gate 23 is opened the voltage at point A, FIG. 3, drops as shown in FIG. 4, graph A. Capacitor 27 causes the drop in voltage to be curved rather than a straight drop. When the gate is opened again the voltage at point A increases. Capacitor 27 again causes the increase in voltage to be curved rather than a straight line increase. This causes a voltage at point A that results in a more efficient use of circuit 20.

Circuit 20 has been shown to drive a light emitting device in a more efficient manner than that of the prior art, circuit 10.

In addition to the above advantages, the present invention does not require any additional parts over that used in the prior art. This may be seen by comparing circuit 10, FIG. 1 and circuit 20, FIG. 3.

Thus, it is apparent that there has been provided in accordance with the invention, a device that fully satisfies the objects, aims and advantages set forth above.

It has been shown that the present invention provides an apparatus that is more efficient than the prior art and it is interchangeable with the prior art.

While the invention has been described in conjunction with specific embodiments thereof, it is evident that many alterations, modifications, and variations will be apparent to those skilled in the art in light of the foregoing description. Accordingly, it is intended to include all such alterations, modifications, and variations in the appended claim.

I claim:

1. A modulation circuit for a light emitting device having a power supply and a ground, said modulation circuit comprising:

voltage regulating means for regulating the voltage, said voltage regulating means having an input, an output and a reference line, said input being coupled to said power supply;

a resistor having a first end and a second end, said first end being coupled to said output of said voltage regulating means and said second end being coupled to said reference line of said voltage regulating means;

a capacitor having a first end and a second end, said first end being coupled to said second end of said resistor and said second end being coupled to said ground;

switch means for providing a signal, said switch means having an input, an output, and a control line, said input being coupled to said reference line of said voltage regulating means;

oscillating means for providing an oscillating signal, said oscillating means having an output being coupled to said control line of said switch means; and light emitting device having an anode and a cathode, said anode being coupled to said output of said switch means and said cathode being coupled to said ground.

2. The modulation circuit of claim 1 wherein said switch means comprises a metal on silicon device having a source, a drain and a gate, said source being coupled to said reference of said voltage regulating means, said drain being coupled to said anode of said light emitting diode and said gate being coupled to said output of said oscillating means.

3. The modulation circuit of claim 1 wherein said oscillating means comprises a square wave generator having an output, said output being coupled to said gate line of said switch means.

4. A modulation circuit for a light emitting device having a power supply, a ground and an output being coupled to said light emitting device, said modulation circuit comprising:

voltage regulating means for regulating the voltage of said modulation circuit, said voltage regulating means having a first, second and third ports, said first port being coupled to said power supply of said modulation circuit;

modifying means comprising a resistor in series with a capacitor for modifying said voltage signal from said voltage regulating means, said modifying means having a first, second, third and fourth ports, said first port connecting said resistor to said second port of said voltage regulating means, said second port being coupled to said third port of said voltage regulating means, and said third port connecting said capacitor to said ground of said modulation circuit;

switch means for providing a signal, said switch means having an input, an output, and a control line, said input being coupled to said fourth port of said modifying means and said output being coupled to said output of said modulation circuit; and oscillating means for providing an oscillating signal, said oscillating means having an output being coupled to said control line of said switch means.

* * * * *